United States Patent [19]

Nordstrom

[11] Patent Number: 4,624,096

[45] Date of Patent: Nov. 25, 1986

[54] HIGH SPEED WRAPPING MACHINE

[75] Inventor: John E. Nordstrom, Two Rivers, Wis.

[73] Assignee: Barbara Nordstrom, Two Rivers, Wis. ; a part interest

[21] Appl. No.: 548,875

[22] Filed: Nov. 4, 1983

Related U.S. Application Data

[62] Division of Ser. No. 507,938, Jun. 23, 1983, Pat. No. 4,426,825, and Ser. No. 187,115, Sep. 15, 1980, abandoned.

[51] Int. Cl.[4] ..... B65B 11/06

[52] U.S. Cl. ..... 53/209; 53/228; 53/590

[58] Field of Search ..... 53/461, 466, 463, 209, 53/216, 228, 230, 590

[56] References Cited

U.S. PATENT DOCUMENTS

| | | | |
|---|---|---|---|
| 2,918,772 | 12/1959 | Bell | 53/228 |
| 2,938,319 | 5/1960 | Nystrand | 53/216 X |
| 3,075,325 | 1/1963 | Liedtre | 53/228 X |
| 3,127,722 | 4/1964 | Schoder | 53/230 |
| 3,385,026 | 5/1968 | Schmermund | 53/228 |
| 3,629,991 | 12/1971 | Sundin | 53/209 |
| 3,750,361 | 8/1973 | Stevens | 53/209 X |
| 3,965,645 | 6/1976 | Ganz | 53/590 X |
| 3,991,542 | 11/1976 | White | 53/228 X |
| 4,069,643 | 1/1978 | Young | 53/556 |

FOREIGN PATENT DOCUMENTS

| | | | |
|---|---|---|---|
| 961757 | 1/1975 | Canada | 53/228 |
| 605178 | 3/1959 | Italy | 53/228 |

*Primary Examiner*—John Sipos
*Attorney, Agent, or Firm*—Wheeler Law Firm

[57] ABSTRACT

A machine for packaging objects such as rolls of paper comprises a direction changing loading wheel to feed objects and groups of objects into closely grouped orientation in the wrapping machine for high speed passage through the machine in a continuous motion generally in a single direction and substantially at a single speed. A wrapper supply mechanism feeds sheets of wrapping material to lie between conveying belts above the article to be wrapped with the leading edge of the wrapper substantially ahead of the article or group of articles to be wrapped. A pair of vacuum wheels alongside the path of the article on axes skewed slightly outwardly from the article path pull the wrapper down in front of the article and allow it to pass underneath as the article passes so that the wrapper becomes wrapped around the top, front and bottom of the articles. Specialized belts and rollers below the periphery of the vacuum wheels assist in smooth transfer of the wrapper without permitting wrinkles at that very high speed. The articles are then transferred from the belt conveyor to bars above and below the article, with chain driven paddles to propel the articles and to wrap the upper and lower portions of the tail of the wrapper about the rear of the articles while at the same time differences in the coefficient of friction between the upper and lower bars snug the wrapper about the article and close any spaces between articles in a group. The ends of the wrapper are folded in and the ends and rear seam are sealed to continuously produce wrapped product groups as the groups move in a linear path, in part by a novel fold tucker.

24 Claims, 28 Drawing Figures

50
51
52
53
54
55
56
57
58
59
60
61
62
63
64
92

Fig. 20
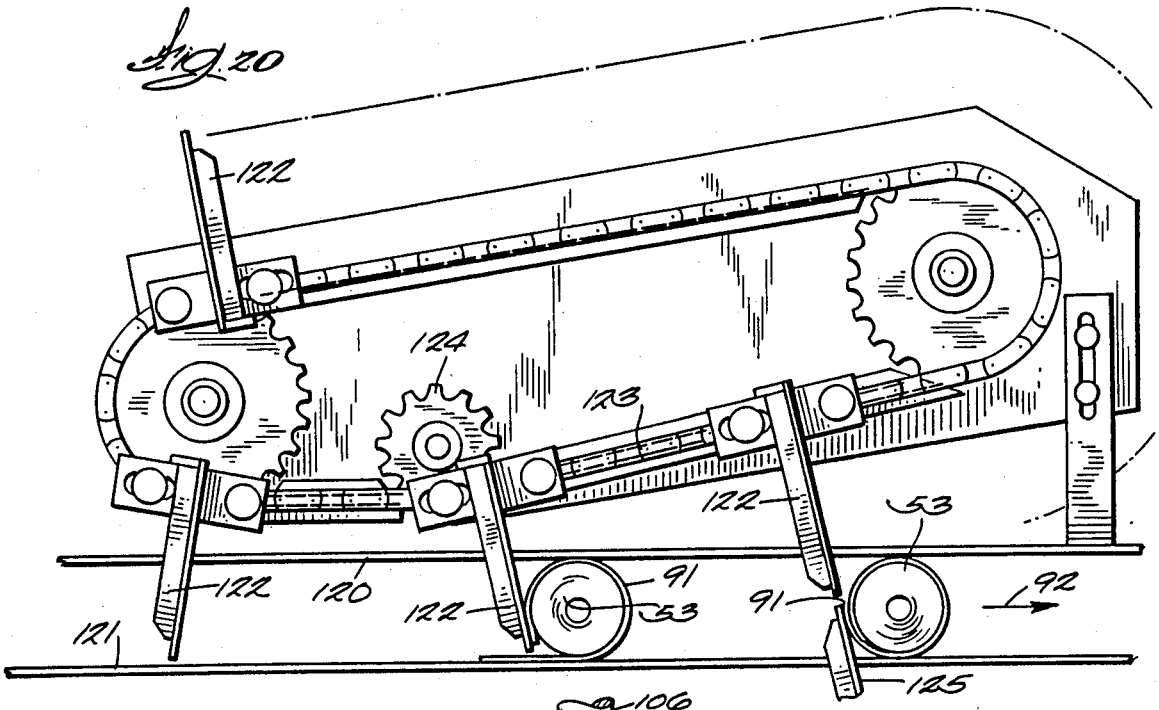
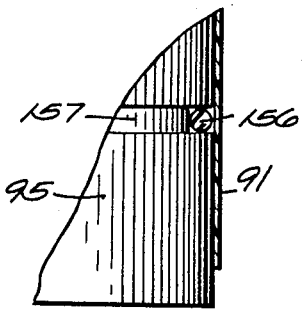
Fig. 19
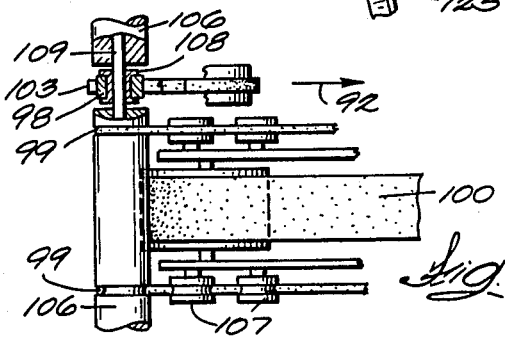
Fig. 17
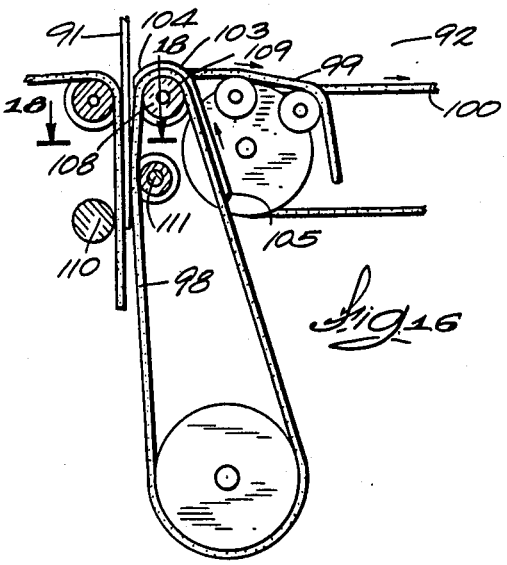
Fig. 16
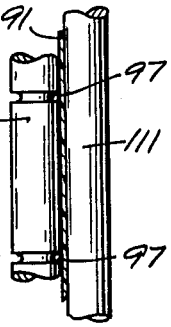
Fig. 18

HIGH SPEED WRAPPING MACHINE

This is a division of application Ser. No. 507,938, filed June 23, 1983, now U.S. Pat. No. 4,426,825 and of Ser. No. 187,115, filed Sept. 15, 1980, now abandoned.

BACKGROUND OF THE INVENTION

A great many wrapping machines are known in the art. Applicant will submit a separate statement of known prior art but the prior art may be summarized by saying that wrapping machines for such products as paper towels and napkins, rolls of tissue, and the like for wrapping individual products or groups of products have not been able to achieve the high speeds which are now needed to wrap economically the output of other machines now available for producing the products. Either it has been necessary to provide an undue number of wrapping machines and to divide product streams among them or other machinery must be operated at the speeds previous wrapping machines could sustain. One reason for such limitations has been changes in the directions of movement of a product as it was being wrapped. Such a change imposes an upper limit on wrapping speed, particularly if the change is a deviation from the direction of movement of the product and then a return to the previous path. Stopping and starting of the product or great changes in speed impose similar limitations. In order to speed the flow of products through the wrapping machine it was necessary to device a number of novel mechanisms and to interconnect them in such a way that either a single product or a group of products could be oriented with respect to the path through the wrapping machine and passed along that path with substantially continuous motion while being wrapped.

The machine will be described with greater particularity below but in addition to the advantage that the product moves substantially in a line and substantially at a single speed which allows very high wrapping speeds, my structure has the advantage of producing a seal to secure the wrapper at the narrow rear face of the product group rather than on the broad face, permitting a neater package with better arrangement of the text which appears on the wrapper. My device also contains a number of novel mechanisms for assuring that the wrapper remains smooth and to pass the wrapper about the product in a unique way and contains novel means for cooperation betwen elements of conveyors, the wrapper, and the product to bring separate products of a product group tightly together just before the wrapper is closed and sealed to produce a tight neat package at speeds which are easily twice those achievable before.

SUMMARY OF THE INVENTION

Several distinct sub-inventions are combined in this application.

A novel transfer mechanism to move articles or groups of articles from a conveyor standing at any angle to the wrapping machine to the first conveyor of the wrapping machine itself consists of one or more product transferring elements which may consist of L-shaped arms mounted on a rotating mechanism in the included angle between an infeed conveyor and the wrapping machine conveyor. These arms are pivoted on a rotating member and each is provided with a cam-track which cooperates with a cam-follower on a second rotating member on an axis offset from the axis of the first member but driven at the same speed. By appropriate design of the cams the transfer arms are able to pick up an article or groups of articles from the infeed conveyor and change their direction of movement to that of the wrapping machine either with, or without the change in the orientation of the articles and without disturbance of a grouping of articles which are to be wrapped together, after which the transfer arm retracts in a path that carries it sideways and out of the way of the wrapping machine, thereafter extending itself behind another product or group of products on the infeed conveyor to repeat the cycle without having to start and stop the product group for the direction change. This mechanism would be adaptable to machinery other than wrapping machines where the articles were to change directions rapidly without stopping.

In addition, a variation of the transfer mechanism serves as a tucker to make an end fold in which the tucker arm moves out and sideways as it retracts, to avoid pulling out the fold just made. The parts are essentially the same as those of the transfer mechanism excepting cam shapes.

Another aspect of my invention is the use of a belt thickened over part of its length to guide the wrapper away from rotating parts that would deflect it from entering a narrow slot accurately at high speed but cease acting on the wrapping to allow it to move in the reverse direction.

Another aspect of my invention is the use of vacuum wheels toed out slightly from each other to grasp a wrapper and change its direction of movement while pulling laterally on it to keep it smooth and allow as little sagging or billowing as possible. A vacuum port open between the vacuum wheels assists by reducing air pressure ahead of fast moving products and behind the wrapper. Film transport belts may be angled.

More generally, my invention comprises a method and apparatus for high speed wrapping which moves a product to be wrapped at high generally constant speed in a substantially straight path, feeds a wrapper entirely at one side of the path more ahead of the product than behind it, moves the leading edge of the wrapper across the path to envelop three sides of the product, pulls the wrapper and any separate articles in the product being wrapped snugly together in a novel way including trapping one back edge of the wrapper and applying differential friction to different parts of the wrapper, then completing closure of the back and ends of the package with the novel tuckers and other closure mechanisms.

DRAWINGS

Figures 14, 15:
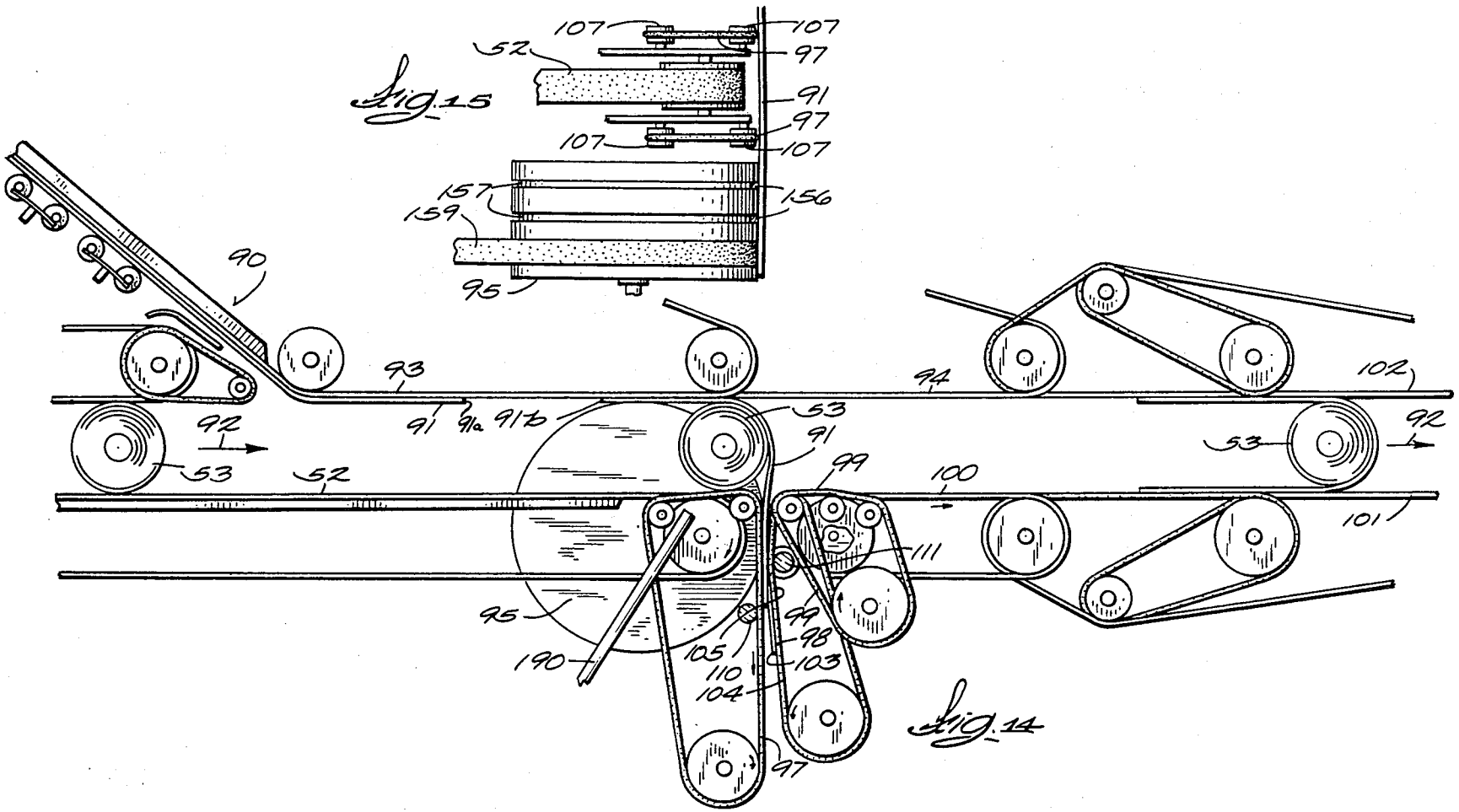

FIG. 14 is a side elevational view showing the portion of my machine in which pre-cut sheets of wrapping approach the product conveyor from above and are disposed alongside the product with the leading edge of the wrapper very substantially ahead of the leading edge of the product to be wrapped and further showing that portion of the machine in which a novel aray of vacuum wheels and belts move the wrapper down across the front of the product as the product passes by a lower slot in the conveying section to leave the wrapper disposed along the top, front, and bottom of the product as it moves to the right in the drawing.

FIG. 15 is a fragmentary top plan view of the slot section where the wrapper is passing downwardly.

FIG. 16 is a vertical cross-sectional view through the slot section.

FIG. 17 is a fragmentary top plan view showing additional details of the belts and rollers in the slot section.

FIG. 18 is a detail of two rollers and associated belts in the slot section.

FIG. 19 is a fragmentary top view of a portion of the vacuum wheel and a belt associated with it as the wrapper moves downwardly in the slot section.

FIG. 20 is a side elevational view of a chain driven paddle conveyor which takes over from the belt conveyor just after the slot section.

Figure 21:
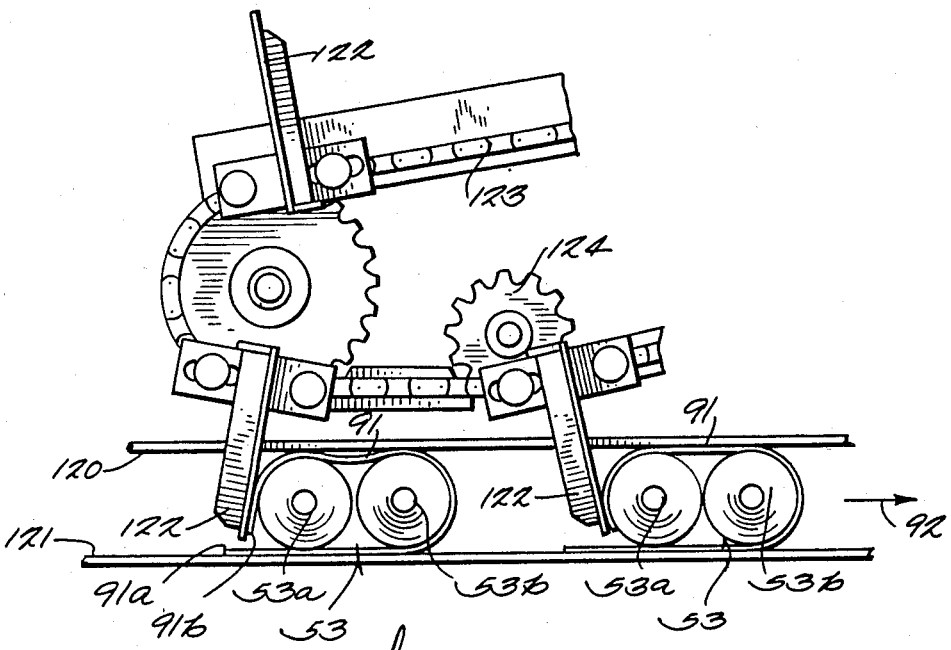

FIG. 21 is a detail view of the same conveyor showing groups of products being pulled together and a wrapper being tightened by a novel configuration of parts and materials in this section of the conveyor.

Figure 22:
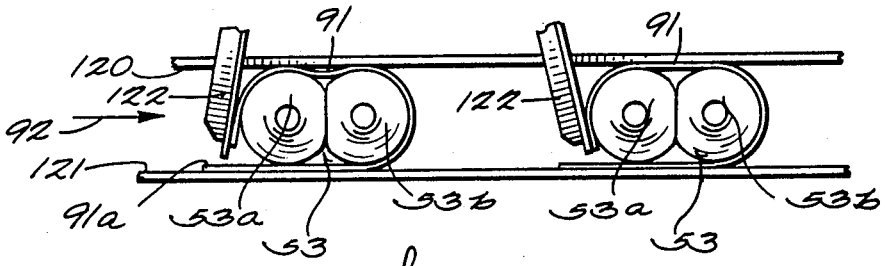
Figure 2:
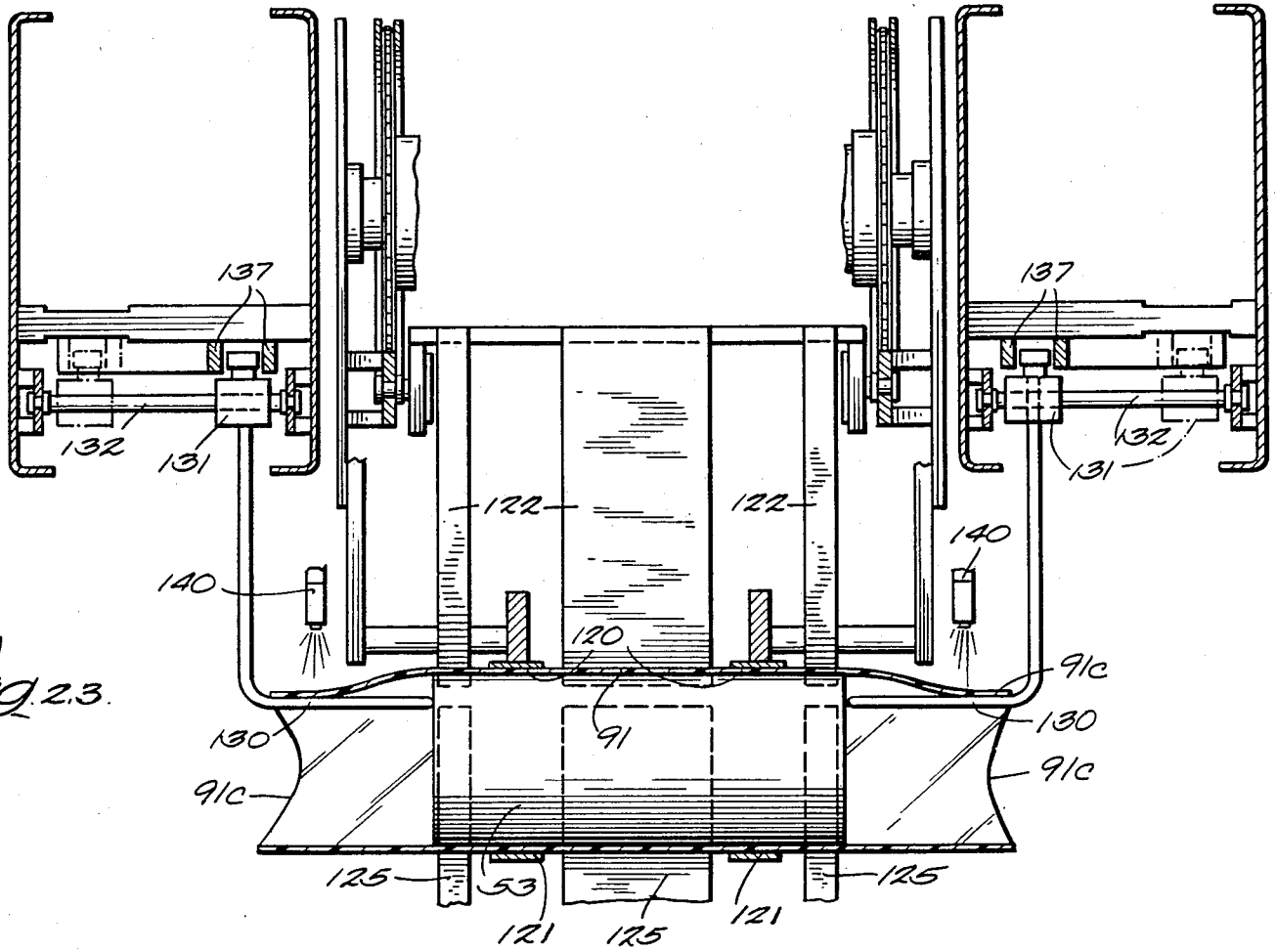

FIG. 22 is a fragmentary view similar to FIG. 21

FIG. 23 is a lateral cross-sectional view showing cooperating paddles of upper and lower paddle conveyors and air jets which assist in making end folds.

Figure 24:
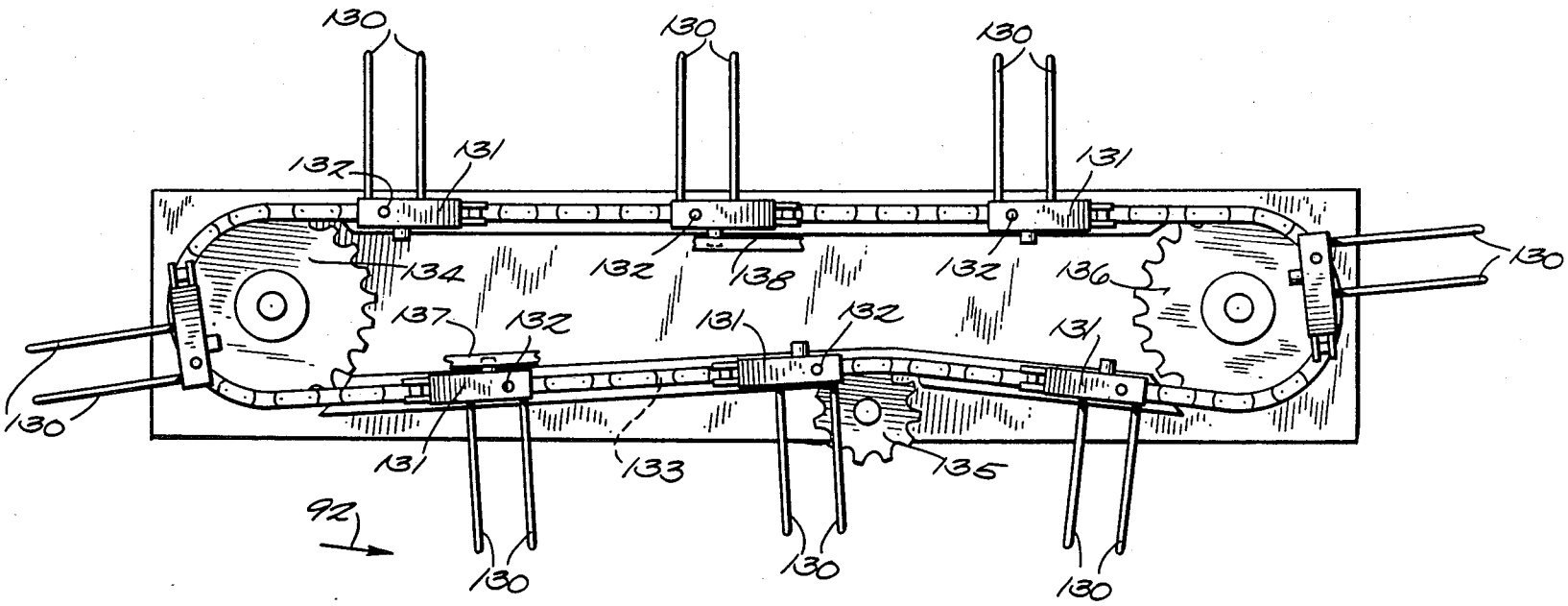

FIG. 24 is a side elevational view of the mechanism that carries the support arms.

Figure 25:
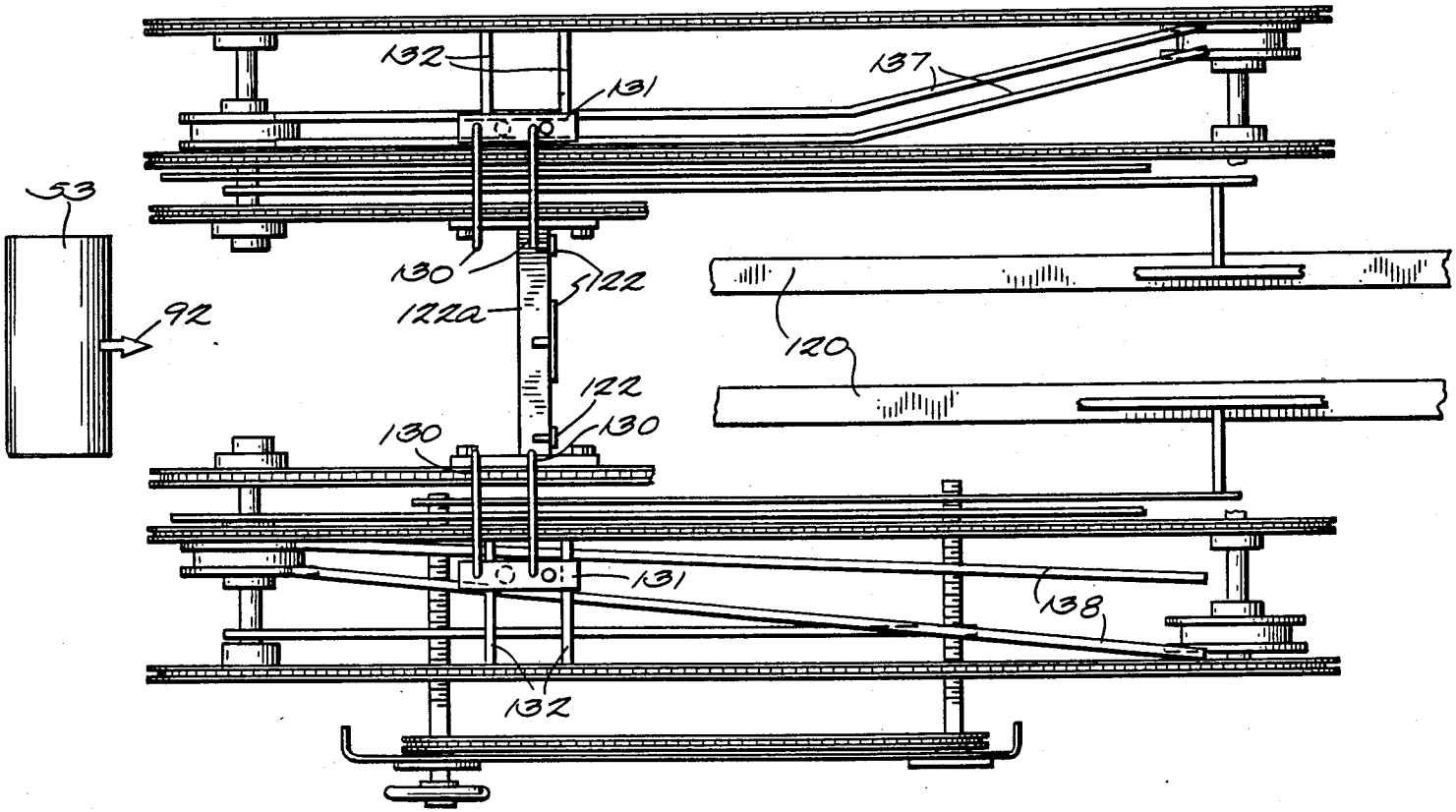

FIG. 25 is a bottom plan view of the mechanism that carries the support arms.

Figure 26:
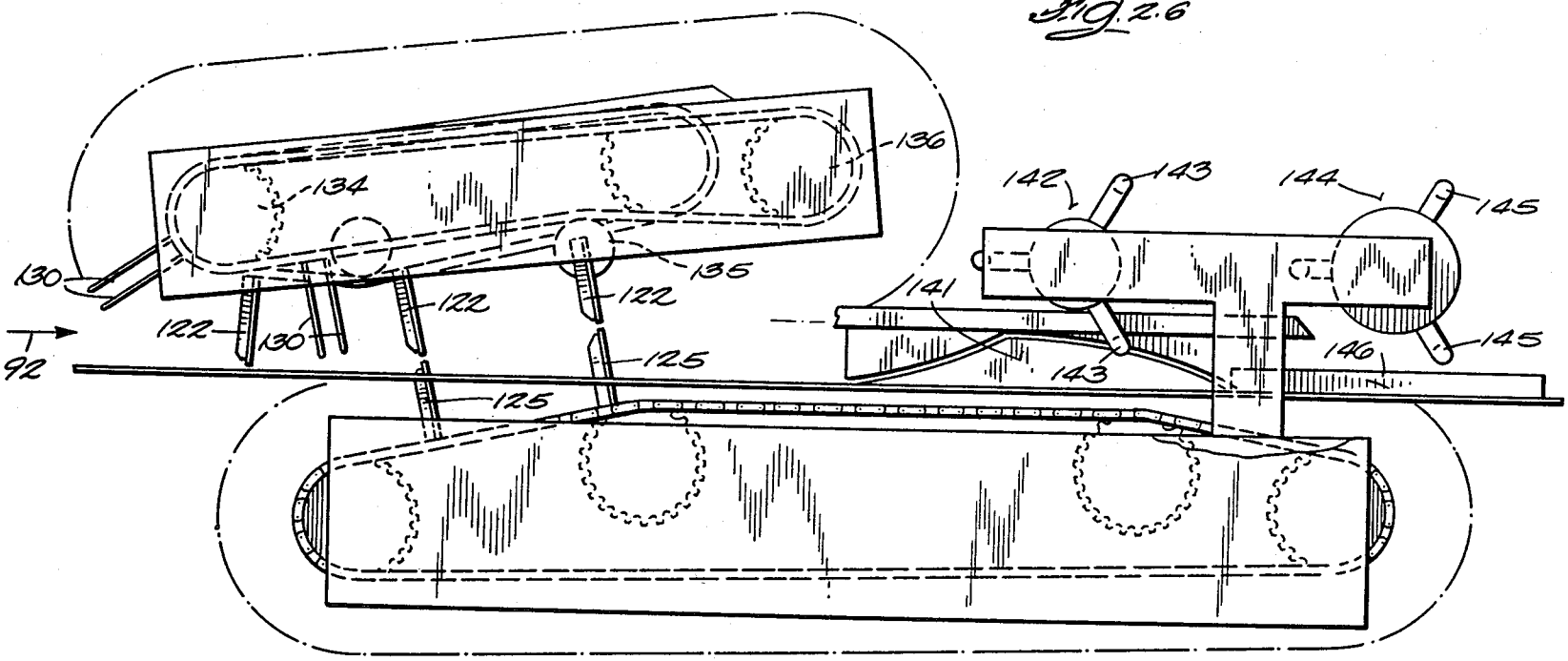

FIG. 26 is a side elevational view of the section of my machine in which the end folds are made and in which the rear seals are accomplished.

Figure 27:
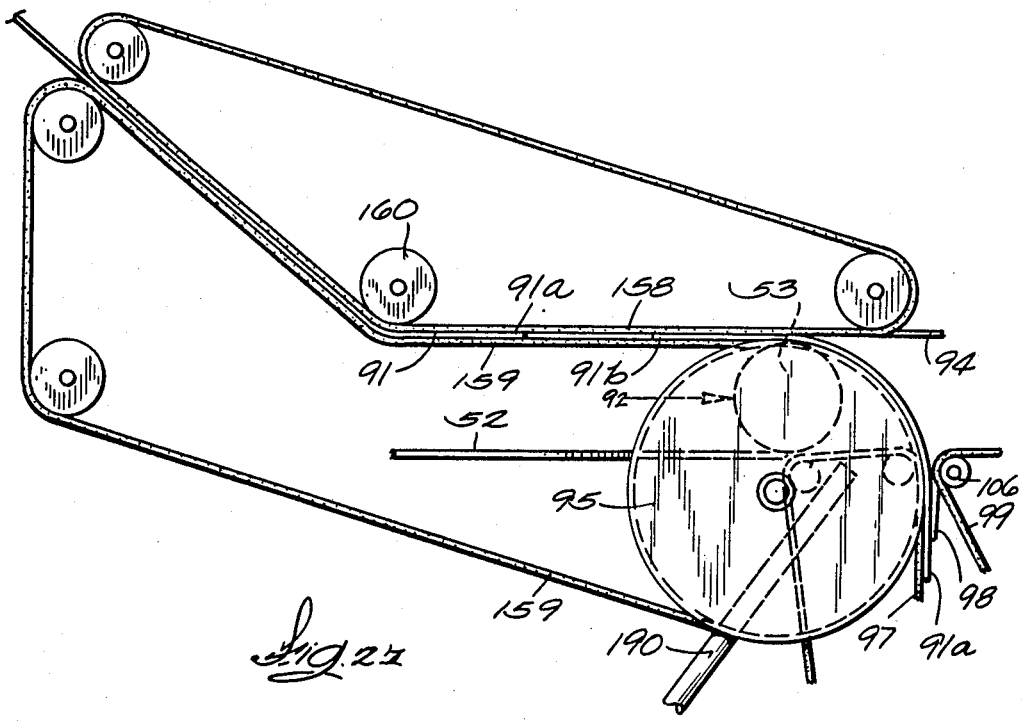

FIG. 27 is a side view similar to FIG. 14 but in a plane through the vacuum wheels to show superimposed timing belts carrying the side margins of the wrapper sheet. Not shown is the support mechanism to toe out the lower belt slightly to smooth the sheet laterally.

Figure 28:
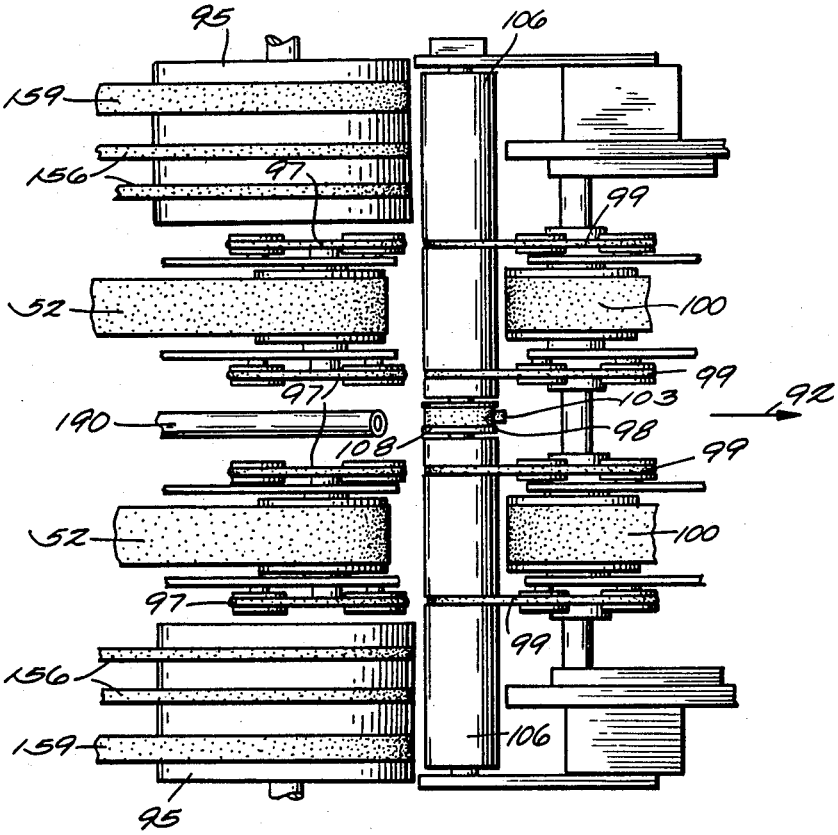

FIG. 28 is a top plan view of the slot section of my machine where the wrapper is transferred across the product path.

DESCRIPTION

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

The machine of this invention has a number of sections which cooperate to achieve the overall result. Each of the sections will be described very generally and will then be described in greater detail. Unless the context indicates otherwise the word "product" refers either to a single article, such as a roll of paper tissue or towelling, or to a single group of articles to be wrapped in one wrapper.

First of all is the direction changing mechanism (FIG. 12) which brings the product to be wrapped from an infeed conveyor extending from a different direction to conveying means in the wrapping machine which thereafter transport the product continuously in a single direction. The direction changing means are unique in their mode of action in that although they change the direction of product movement, they do not change the orientation of the product, and do not significantly change its speed, utilizing a mechanical motion believed to be unique and which may be utilized in other devices, such as my tucker.

Figure 1:
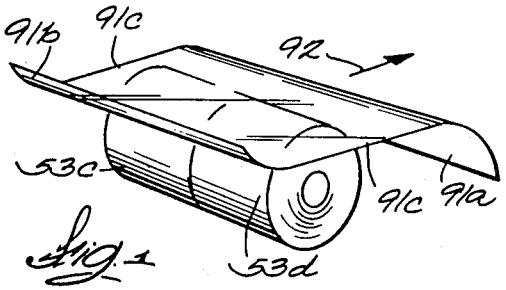
FIGS. 1 through 11 are a series of perspective views showing the sequence of steps in the wrapping process.

After entering the wrapper machine proper through the direction changing mechanism, the product passes beneath a wrapping film supply section (FIG. 14) fed from a roll of wrapping material from which sheets of wrapping film are cut and supplied to lie in a horizontal plane above the product supported by conveying structure that will be described later. (FIG. 1) The wrapping film is supplied in a specific relationship to the product such that an amount of film sufficient to wrap the forward side, bottom and part of the back of the product extends ahead of the product as it moves down the conveyor, the remainder extending above and behind the product. The wrapper is carried between pairs of belts moving beside the product at the same speed.

Figure 2:
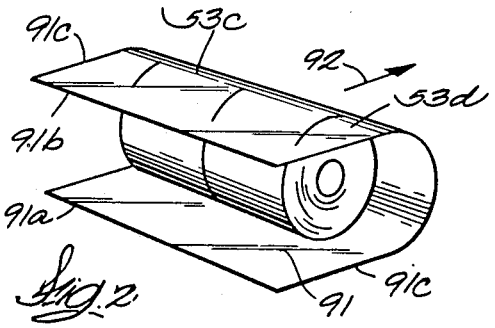

As the product and wrapping film proceed down the conveyor from the film supply area the lower wrapper carrying belts turn on vacuum wheels so the edge of the wrapping film is brought downward ahead of the product (FIG. 14) by engagement with the vacuum wheels which are rotating on either side of the product with axes that are not quite transverse to the conveyor but are skewed or toed outward slightly to create a slight outward pull on the wrapping film as it moves downwardly in contact with the vacuum rolls. The vacuum wheels must grip lightly to prevent wrinkles. As the forward edge moves downwardly it is stripped from the vacuum wheels by belts which nip it lightly and assure its continued travel vertically downward as it leaves the vacuum roll. A large number of belts and rolls in this vertical slot smooth and control the wrapper. As the product moves over the slot area in which the wrapping film was pulled downwardly, the film is pulled taut at the forward edge of the product and is withdrawn from its downward extension into the slot to cover the bottom surface of the product as the product advances so that the film now extends in a horizontally disposed U from behind the product at the top around the top, front, bottom, to behind the product at the bottom (FIG. 2).

Previous to this point both the film and the product have been conveyed on belts but the product now enters a portion of the conveyor (FIGS. 20–23) comprising stationary upper and lower rails with paddles moving behind the product to advance it and to fold the wrapper back of the product. These paddles fold the upper film down over the back of the product (FIG. 3) and because they are advancing the product hold the film tightly. As shown in FIGS. 21–22, at this stage when groups of articles make up a product to be wrapped, there may be a droop in the wrapping film between products of a group, either because the group has separated slightly or for other reasons. To produce a neat smooth wrap the articles should touch or even compress together. In my machine, with the upper portion of the film held tightly against the back of the product by the advancing paddles (FIGS. 3 and 21–22) the friction of the passage of the products and film along the conveyor bars cause very slight drag on the film. The upper stationary bars of the conveyor are selected from material and finish having slightly less friction than the lower stationary bars of the conveyor, with the result that with the film nipped between the advancing paddles of the conveyor and the back of the product, and greater friction on the lower portion of the film than the upper portion of the film, the film is gradually pulled around the lower side of the product a tiny amount which snugs the articles in the group tightly together and pulls the wrapping film tightly about them. (FIG. 21–22)

It is a major objective of this invention to wrap products by moving them linearly without stopping in a manner such that the products to be wrapped are wrapped tightly by the film to produce a package which is compact and free of wrinkles. A secondary but still major objective is to seal the package so produced on a narrow edge which in the direction of product travel in my machine is a rear surface, particularly where multiple articles are being wrapped. The rear surface being one of the narrow surfaces of the package this permits maximum printed display area on the broad surfaces of the package which is not defaced by a seal. In this machine the objective is achieved regardless of the number of articles in a package, the number typically ranging from one or two 11 inch rolls of toweling through one, two, or four rolls of toilet tissue. Other articles may be wrapped.

During this period support fingers (FIGS. 3–5 and 23–25) approach the product at the side and move up to support that portion of the film that extends sidewardly or transversely from the product. In the same section of the machine the paddle type conveyor that has previously been described as coming down in back of the product from above to nip the film against the product to allow tightening travels upwardly at a slight angle to the product path while a lower chain carrying upwardly extending paddles travels from below at a slight upward angle to the product path so that as the upward paddle is withdrawn, the lower paddle moves upwardly to take its place, folding the film upwardly around the back of the product at the same time. (FIGS. 4,23 and 26) Both the lower paddles and the upper paddles are discontinuous so that a mechanism can later come in to make a first attachment of the lower film to the upper film to retain the tight configuration of the wrapping about the product at a later time. If the wrapper is plastic film as generally described throughout, the mechanism is a tack welding wheel to bond the plastic. Other wrapper stock and sealing means are possible.

Figure 3:
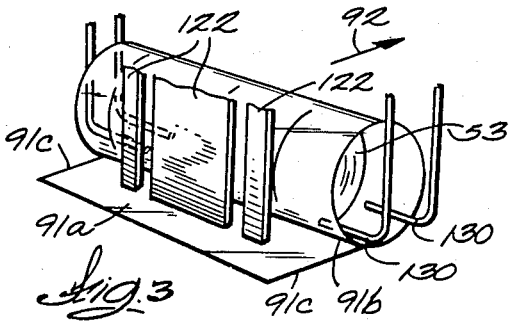
Figure 4:
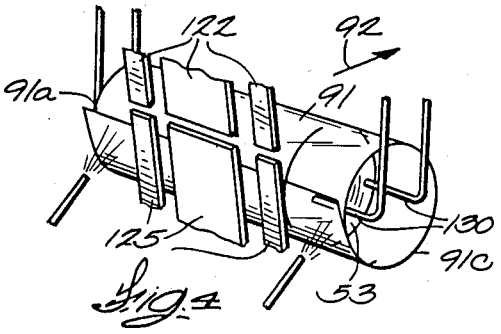
Figure 5:
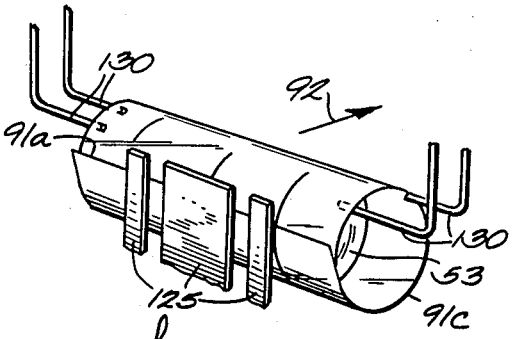

Before this time the laterally extending fingers are withdrawn from supporting the upper film, (FIGS. 3–5). An air-jet (FIG. 6) pushes the upper film downwardly at the ends of the package to make the first end fold. A tucker (FIGS. 7,11, and 13) makes an end fold and the package then moves into a conventional end folding section of the machine which folds the remaining side portions of the film to make end folds. The tack-welding is then accomplished (FIG. 8) between the paddles of the lower paddle conveyor, which then withdraw downward. The product moves between belts that engage the ends of the product (FIG. 9) which serve to convey the product down the product path as a full back seal bar comes in to permanently seal the back seam. The package then moves between end sealing belts (FIG. 10) producing a completely sealed product while the package continues its path.

Figure 10:
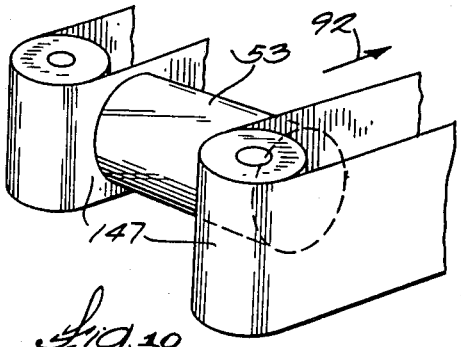
Figure 11:
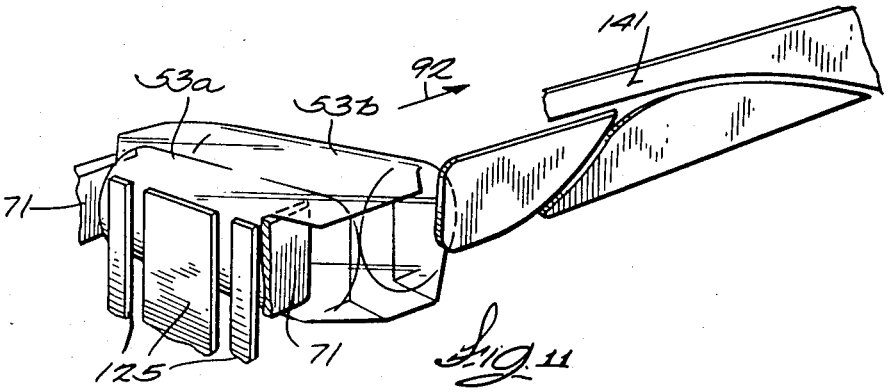

As shown in FIG. 11, the sealing is effected in just the same way if the product group includes more than one product. FIG. 11 may represent the wrapping either of two rolls of towel or four rolls of toilet tissue. Thus, FIGS. 1 through 10 schematically represent the steps in applying the film to the product to form a complete package while FIG. 11 represents a view like that of FIG. 7 where more than one product is involved in the axial direction of product flow.

The linear path of product flow is the path extending horizontally from one end to the other end of the wrapping machine. The product moves without substantial deviation in direction or speed while it is being wrapped. The linear product path could be other than horizontal, but as the preferred form is here described the path is level. The reason for having a generally linear product path is to allow very high speed wrapping of the product, at a rate much higher than accomplished by previous machines which do not have a linear product path or which started and stopped the product or substantially changed its speed during the course of wrapping. While linear flow and generally uniform movement of the product are important to high speed wrapping, they are by no means sufficient, as is shown in this application. Many innovative details were necessary to solve the problems of high speed wrapping, in addition to the general concept.

The basic axis of the machine will be taken to be the product path. To the right and the left of the product path the directions will be referred to as side, lateral or transverse. The remaining directions at right angles to the product path will be referred to as up and down. In the event of a machine oriented otherwise than horizontally, right and left side, lateral or transverse directions will be taken to be directions lateral to the first conveyor and (generally) aligned with the axes of the vacuum wheels, while up and down would refer to directions at right angles to those.

Figure 12:
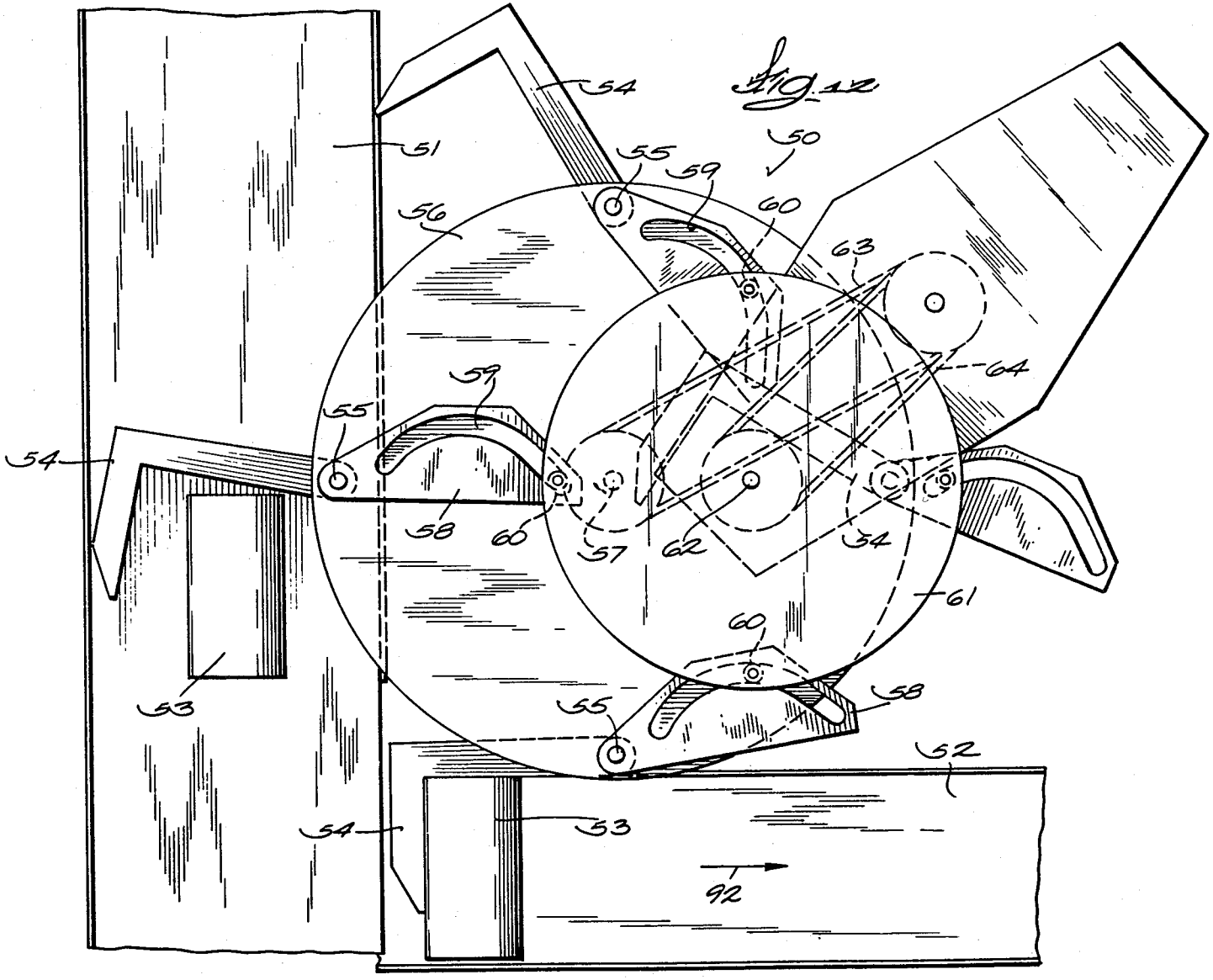
FIG. 12 is a top plan view showing my novel article transfer device between an infeed conveyor and a wrapping machine conveyor.

Looking now at FIG. 12, the wrapping machine proper begins with a direction changing mechanism 50 operating to move articles 53 from conveyor 51 which is an infeed conveyor, toward conveyor 52 which is the first element in the conveyors defining a linear product path on which products will be wrapped. Operating in the angle between the two conveyors is my direction changing mechanism 50 which could operate between conveyors in other mechanism as well. The direction changing mechanism includes L-shaped arms 54 secured to shafts 55 extending through respective bearings in rotating member 56 which is rotated about a bearing 57. A cam plate 58 having a cam slot or track 59 is rigidly secured to the top of each shaft 55. A cam follower roller 60 enters each cam track or slot 59 from a second rotating member 61 driven to rotate around a bearing at center 62. Belts 63 and 64 which may desireably be timing belts drive rotating members 56 and 61 about their respective centers 57 and 62 at equal rotational speeds.

The action of L-shaped arms 54 is to synchronize behind product 53 on infeed conveyor 51 enclosing the back and end of the product. The precise shape of the arm might vary with product type and shape and cam shape but should prevent separation of articles making up a product to be wrapped as products are swept in an arc from conveyor 51 to linear product path 92 without change in product orientation. As applied to rolls of paper, rolls with axes along conveyor 51 now have axes directed laterally of product path 92 as they are placed between upper and lower belts. Arms 54 retard respecting products 53 and withdraw to the side, then move at high acceleration to come behind a product on infeed conveyor 51 and synchronize with it to repeat the cycle. The number of arms and exact cam shape may vary, and of course cams and cam followers could be reveresed, with appropriate design changes, here or in the tucker of FIG. 13.

FIGS. 14 and 27 show the manner in which successive wrappers or sheets 91, which are desirably plastic wrapping film, are fed by a more or less conventional cutting and feeding mechanism 90 to overlie the linear product path 92 shown as a directional arrow. Wrapper 91 is supported at each side margin between opposed timing belts 158,159 (FIG. 27). In the plane of FIG. 14 upper conveyor belts 93 and 94 are visible. These extend over pulleys having different paths in order to provide a smooth transport of the wrapper or sheet 91 and the product 53. Similar belts are visible at the left end of the drawing. These belts define the linear product path 92 for product 53 as it approaches the wrapper 91 being fed with its forward edge well ahead of product 53 as shown at the left and center of FIG. 14, and in FIG. 27.

At the center of FIG. 14 vacuum wheels 95, rotating with its upper surface tangent to wrapper or sheet 91, is provided with a lowered pressure in its interior and openings in its surface of a size and number appropriate to grip the particular wrapper 91 and transfer the front edge of the wrapper across the product path 92 and down at right angles to the product path. Baffles (not shown) direct the vacuum.

Because the wrapper is across the product path 92 and the lower conveyor belts partially block the space below, product 53 tends to push air ahead of it and billow out the wrapper 91 from its proper path. A vacuum or low pressure pipe 190 is desirably provided between vacuum wheels 95 to decrease this tendency.

The belts that carry the side margins 91*c* of wrapper 91 are best seen in FIG. 27 which is similar to FIG. 14 but in a plane outside product path 92. Belt 158 is the upper wrapper conveyor belt and belt 159 is the lower wrapper conveyor belt. Both are desirably timing belts with flat backs in contact with one another, separated only by sheet 91. They extend from wrapper supply area 90 over idler 160 to lie along the top side of linear product path 92. At vacuum wheel 95, upper belt 158 goes straight on a short distance before returning. Lower belt 159 extends in an appropriate groove in vacuum wheel 95 and then to an idler to eventually return to film supply unit 90. Film 91 adheres to vacuum wheel 95 and is later stripped from it by belts 156 that run downward from grooves 157 in vacuum wheels 95.

Film 91 is further prevented from billowing out by slight outward movement of belt 159 and of vacuum wheel 95, but not belt 158, with respect to the product path 92 to cause moderate lateral smoothing movements against film 91, but not large forces. As described elsewhere, belt 98 is built up in thickness to guide film 91 downward while edge 91*a* moves downward, and keep it away from the upwardly moving surface of roller 106. Edge 91*c* of the film is grasped and pulled downward lightly by belts 97 and rollers 110 and 111 on both sides of the slot until product 53 passes from conveyor belts 52 to conveyor belts 99 and 100 (FIGS. 14,16, and 18). Belts 156 only extend a short distance below vacuum wheel 95. The wrapper 91 is stripped (FIG. 19) from the vacuum wheel 95 by belts 156 which are round belts smaller than grooves 157 in the vacuum wheel which guide the forward edge of sheet 91 tangent to the vacuum wheel in a downward direction with respect to product path 92 rather than having the sheet adhere to the vacuum wheel 95. Belts 156 are not visible in FIG. 14 but the downward path of sheet 91 is visible, as are belts 97 and 98 which also assist in guiding sheet 91 in its downward path in the slot between conveyor belts 52 and 100 which form a part of product path 92. Upward moving belt 99 does not touch wrapper 91 as it moves downwardly into the slot but does touch it as product 53 passes the slot and begins drawing wrapper 91 out of the slot. Belt 101 takes up the conveying function further down linear product path 92. Corresponding belts 94, 102 serve as upper conveying belts and are continuous rather than being interrupted at the slot area. FIG. 19 is a detailed view of the surface of the vacuum wheel, a slot 157, and belt 156 which is smaller than the slot underlying wrapper sheet 91 while the sheet adheres to the vacuum wheel. FIGS. 16, 17 and 18 are additional detail views of the slot area. FIGS. 16 and 17 are respectively side and top views. The objective is to strip sheet 91 from the vacuum wheel 95 by means of belts 156 and thereafter to continue the motion of sheet 91 away from product path 92 at a convenient angle which will usually be something approximating a right angle without wrinkling, bunching, stretching or tearing until, and only until, product 53 begins to cross the slot between the belts on one side such as belts 97 and the belts on the other side such as belt 98. In order to achieve this a number of important details cooperate. As best shown in FIG. 15, vacuum wheel 95 is not precisely parallel to conveyor belt 52. The edge of vacuum wheel 95 tangent to the slot between conveyor belts 52 and 100 lies a small distance farther from conveyor belt 52 than the back edge of vacuum wheel 95. At the opposite side of the machine the vacuum wheel 95 is toed out in the opposite direction so that as the two sheets turn in unison at the speed of sheet 91 a given point on the surface of wheel 95 is moving laterally very slightly with respect to sheet 91 and tending to smooth it. Round belts 97 are used at intervals along the slot on the left side (FIGS. 15 and 28) and belt 98 on the right. These belts and sheet 91 pass between rollers 110 and 111 (FIGS. 14,16 and 18) arranged to pull downwardly on sheet 91 with a very low coefficient of friction to guide sheet 91 smoothly into the slot during the period when product 53 is approaching the slot. Roller 111 is relieved for belt 98.

As shown in FIG. 18 belts 97 ride on grooved roller 110 almost opposed to smooth roller 111 on opposite sides of the slot, with wrapper 91 between, as best shown in FIG. 14. Small belts are able to turn on a much smaller radius, than conveyor belts such as 52 and 100 which are heavier and require larger pulleys. Thus small belts provide a much narrower and more precise slot. They may also be made of material which does not pull unduly on wrapper sheet 91 when product 53 crosses over the slot and begins withdrawing the wrapper 91 from the slot in opposition to its previous motion into the slot, but which keeps it taut and smooth.

Another mechanism used to assure smooth movement of wrapper sheet 91 into and out of the slot is a very special portion of belt 98 best shown at FIGS. 16 and 17. Belt 98 is provided with a built up portion 103 having a leading edge 104 and a trailing edge 105 extending along the flat outer side of the belt for a short distance as seen in FIG. 16. FIG. 17 shows that the body of belt 98 is supported on a small sheave 108 on a spindle 109 on which the two rollers 106 that serve as sheaves for belts 99 are mounted. As clearly shown in FIG. 17 this allows belt 98 to be mounted so that the back of the belt does not extend as far as the surface of roller 106 and therefore can never touch sheet 91. However, built up portion 103 extends the belt radially beyond the periphery of rollers 106 out to the edges of belt 96. Furthermore, as shown in FIG. 16, sheave 108 and shaft 109 that support belt 98 between rollers 106 are mounted further to the right with respect to the right side of the slot than roller 111 which deflects belt 98 back towards the film 91 so that its furthest leftward extension is just below the top of the slot. Belt 98 is timed so that leading edge 104 of built up portion 103 of belt 98 arrives at the slot generally simultaneously with the front edge of wrapper sheet 91. In that respect FIG. 16 is inaccurate in that for clarity wrapper sheet 91 has been shown farther down in the slot than it would in fact be at the time when thickened portion 103 of belt 98 is in the position shown. During the time when thickened portion 103 is in contact with wrapper 91 it pushes wrapper 91 against descending belts 97 on the left side of the slot assisting wrapper 91 in downward movement. At the time when product 53 reaches the position shown at the center of FIG. 14 the thickened portion of belt 98 has traveled downwardly until trailing edge 105 of thickened portion 103 is clear of roller 111 and is no longer able to push sheet 91 against the descending belts on the other side of the slot. Thus at the moment when product 53 is crossing the slot and beginning to pull sheet 91 upwardly, assisted by belt 99, which rotates upwardly rather than downwardly but touches wrapper 91 only at the edge of the slot as best shown in FIG. 14, upward forces are exerted on sheet 91 by the movement of product 53 as it is conveyed by belts 94 and 100 and by belt 99. However, belts 97 and rollers 110 and 111 still exert a small downward force at their respective locations all across the slot (the parts not shown in FIG. 15 and FIG. 17 are mirror images of the parts that are shown) so that wrapper sheet 91 is dragged downward by light forces while it is being moved upward by the movement of product 53 to keep it smooth. As seen at the right side of FIG. 14 the net result is to transform the forward edge of wrapper sheet 91 into a second trailing edge at the bottom of the product 53. The same result would be obtained with a different sized wrapper sheet 91 (FIG. 11) if two rolls of paper 53 were wrapped with one ahead of the other, such as kitchen towels, or if four rolls of toilet tissue were being wrapped. Other configurations are practical and other product shapes than cylinders are practical whether one article or more than one article comprise each wrapped product. As also shown at the right side of FIG. 14 conveyor belts 94 and 100 which define the upper and lower sides of the linear product path in this area give way to belts 101 and 102 which feed products 53 with the wrapper in a U shape about the top, front and bottom into the next section of the linear product path. FIGS. 20–22 are to the right of FIG. 14 in the direction of linear product path 92. Product 53 is inserted by belts 101 and 102 between fixed upper surface 120 and lower surface 121 which in my preferred machine comprise at least a pair of upper bars and a pair of lower bars with surfaces that touch wrapper 91 under light pressure which in the case of a compressible product such as rolls of paper may be provided by positioning the bars to compress the product lightly. I have found that in actual practice wrapper 91 may not be as tight around product 53 as is desirable for a smooth wrapping, particularly if as shown in FIGS. 21 and 22 product 53 comprises more than one article. The articles which make up product 53 may not be in contact as shown at the left of FIG. 21 and wrapper sheet 91 may sag between the articles as shown at the left sides of both FIG. 21 and FIG. 22.

However, surface 120 is arranged to supply less drag against wrapper sheet 91 than surface 121, either by selection of materials, surface finish, area of contact, or whatever method appears best for a particular product. In my preferred machine surface 120 has a lower coefficient of friction with sheet 91 than surface 121 has with sheet 91. It will be remembered that surfaces 120 and 121 are stationary, rather than being moving conveyor belts like belts 101 and 102. Accordingly the job of propelling product 53 along linear path 92 has been taken over by paddles 122. They serve as propelling members, being mounted to enter path 92 at timed intervals behind product 53. As shown in FIGS. 20 and 21 this is achieved in the preferred machine by mounting paddles 122 on a chain 123. As shown at the center of FIG. 20 a paddle 122 secures the trailing top edge of wrapper 91 against the rear of product 53 as it propels product 53 down path 92. The higher friction at surface 121 than at surface 120 causes wrapper 91 to migrate around product 53 toward surface 121 until it is stopped from doing so by the fact that the trailing top edge is secured by paddle 122 and therefore tightness of the wrapper around product 53 is assured. As shown in FIG. 21 this is so even if the articles making up product 53 to be wrapped are not touching as they enter between surfaces 120 and 121 or in the more likely case that wrapper 91 sags between the articles so that as shown at the right side of FIGS. 21 and 22 wrapper 91 will be taut and smooth as it progresses between surface 120 and 121.

As also shown in FIG. 20 a sprocket 124 changes the direction of chain 123 so that paddles or first propelling members 122 rise slightly as they travel between portions of surface 120 which are separate bars.

Looking now at FIGS. 3, 4, 5, and 6 and at FIG. 26 it will be seen that in addition to the upper chain 123 carrying paddles 122 there is a similar lower chain carrying paddles 125.

This chain is like chain 123 and is arranged to have a run parallel to it in the inclined portion so that paddles 125 begin propelling product 53 in timed relationship to paddles 122 and as paddles 122 rise out of the way paddles 125 raise between surfaces 121 to continue to propel product 53 and at the same time to smoothly raise the trailing edge of wrapper sheet 91 against the rear of product 53 as shown in FIG. 20 and FIG. 4.

In order to assist in distinguishing the edges of wrapper sheet 91 the forward edge of the sheet has been labeled 91*a*, the rearward edge 91*b* and the sides 91*c*. It will be noted that the same relationships obtain whether product 53 is a single article or whether as shown in FIGS. 21 and 22 it comprises at least two articles 53*a* and 53*b*. It will be further noted that product 53 could be divided axially as well, so that product 53*a* might consist of two rolls of toilet tissue or three rolls of toilet tissue with no change in any of the parts or methods described except that there might need to be more of some parts to support the separate parts adequately and there might need to be additional belts in the slot to guide edge 91*a* of sheet 91 adequately.

Returning to the description of the machine itself, as best shown in FIGS. 3,4, and 5 and at FIGS. 23 through 25 pairs of fingers 130 are arranged to enter the tube forming by sides 91*c* of wrapper 91 at the bottom of the tube, to progress in timed relationship to product 53 As the horizontal portions of fingers 130 move along they move first into product path 92 to the position shown in FIG. 3. They then rise relative to product 53 as they travel to successive positions shown in FIGS. 4 and 5 causing the wrapper edges 91*c* to regain their circular form it it is distorted for any reason. As may be seen in FIG. 5 the fingers 130 are beginning to withdraw axially as they progress along with product 53. Looking now at FIGS. 23, 24, and 25 it will be seen that each pair of laterally extending fingers 130 is mounted by a vertical extension to a block 131 carried on rod 132 which is part of a chain 133. looking at FIG. 24 the vertical movements of the fingers 130 described in FIGS. 3,4 and 5 are produced by the alignment of the respective sprockets 134,135 and 136. Looking at FIG. 25 in which we are looking upward at a bottom plan view of the mechanism driving fingers 130 as seen from product path 92 it will be observed that blocks 131 slide laterally on rods 132 under the urging of lower cam tracks 137 shown at the top of FIG. 25 which control the motion of blocks 131 while they are on the lower run of the chain, and upper cam tracks 138 shown at the lower side of FIG. 25 which return blocks 131 to their starting position while they are on the upper run of chain 133. For clarity of illustration only the lower cam tracks 137 have been shown at the top of FIG. 25 although both lower cam tracks 137 and upper cam tracks 138 are present. Likewise at the bottom of FIG. 25 only upper cam tracks 138 are shown although both lower cam tracks 137 and upper cam tracks 138 are present respectively adjacent the lower and upper runs of chain 133. In FIG. 23, at the left and right sides, the block 131 in full lines shows the position when fingers 130 are closest to product 53 while the dashed lines show the extent of its movement laterally without showing its movement vertically.

Figure 6:
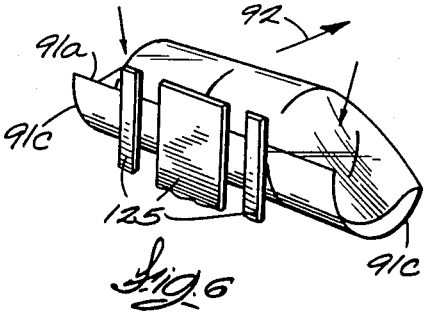

As shown in FIG. 23 and in FIG. 6, as fingers 130 withdraw laterally from product 53 to give less support to margins 91*c* of the wrapper sheet 91 a jet 140 pushes margins 91*c* downwardly to begin the process of forming end folds for product 53 from side margins 91*c* of shape 91. I find that this is simpler than a mechanical motion for the same purpose.

Not discussed previously is the fact that both first propelling members 122 and second propelling members 125 are in fact 3 separate propelling members lying in a single plane to act as a single propelling member 122 or 125. In FIG. 25 propelling members 122 are connected by member 122*a*. Similar members connect each paddle 122 and each paddle 125 leaving openings between them for a reason which will be discussed in a moment.

Figure 7:
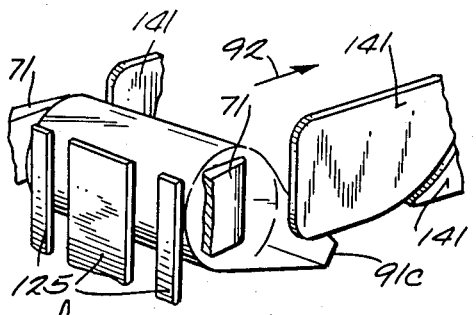
Figure 8:
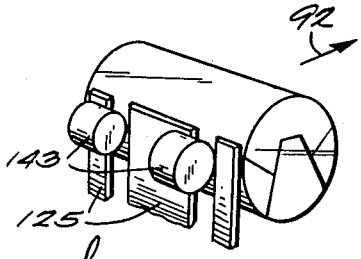
Figure 13:
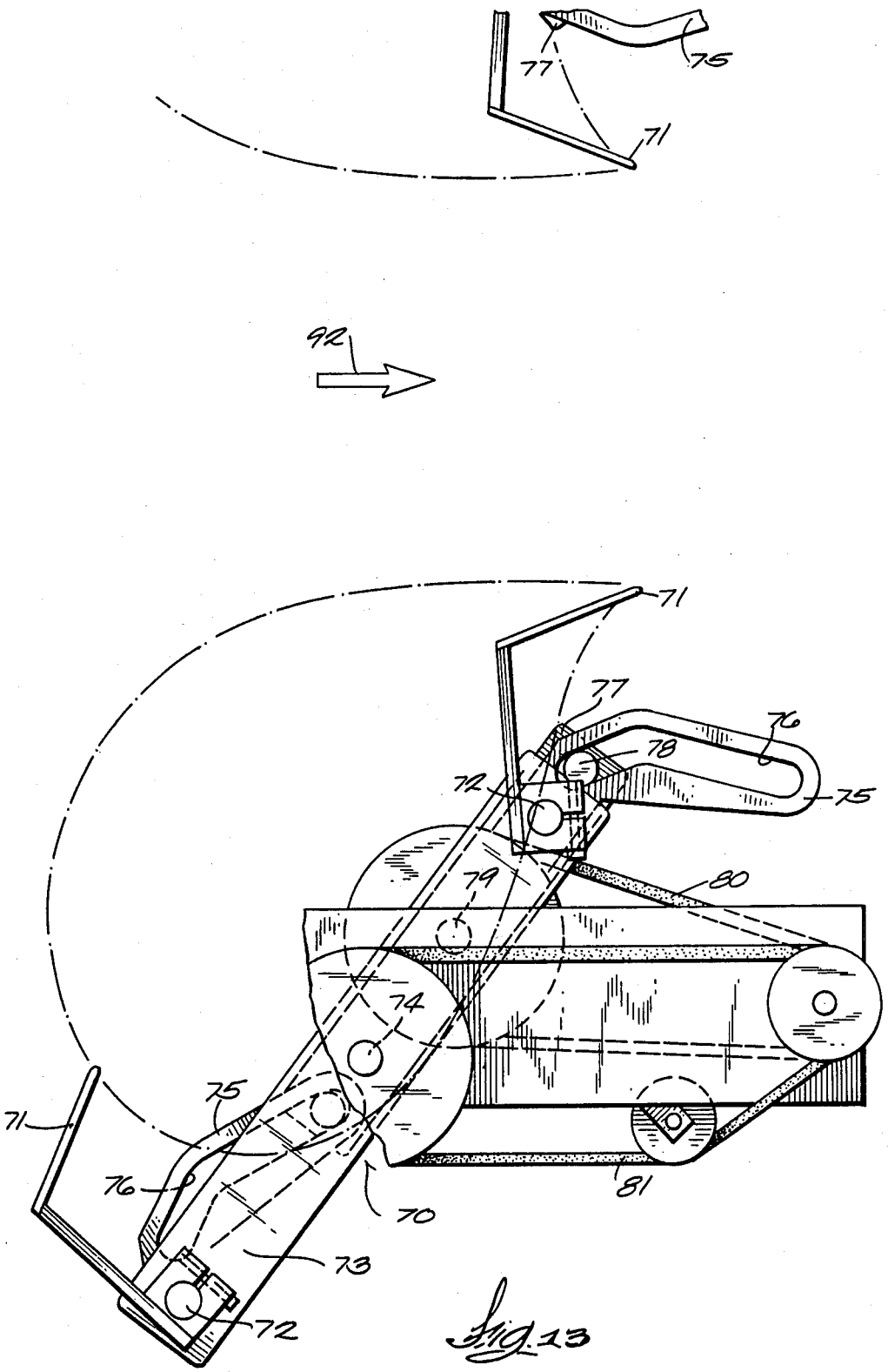
FIG. 13 is a top plan view of a tucker mechanism to form an end fold in the wrapper and showing the trajectory of the tip of the tucker arm, particularly the way it tilts to the side as it backs out of the fold using mechanism similar to FIG. 12.

As shown in FIGS. 7 and 26, fingers 130 have been withdrawn and air-jets 140 have commenced folding the sides 91*c* of the wrapper sheets 91. FIG. 13 shows the tucker (visible in FIG. 7 at 71), and a preferred trajectory for the tip of the L-shaped arm. The tucker is a modified form of my direction changing device of FIG. 12. Tucker 70 has L-shaped arms 71 clamped to shafts 72 extending through bearings in rotating member 73 driven to rotate around a center shaft 74. Each shaft 72 carries a cam plate 75 having a cam track 76. A second rotating member 77 carries a cam follower 78 which enters cam track 76. Second rotating member 77 is driven to rotate around shaft 79. As in FIG. 12 timing belts 80 and 81 assure that the rotational speed of members 73 and 77 will be equal though any drive that assure equal speed will be appropriate. Throughout my mechanism the timing of the parts is important and it will be understood without specific mention that wherever synchronism is important the belts are timing belts and the drives of the various mechanisms are so connected as to insure synchronism.

In FIG. 13 the track of the tip of L-shaped arm 71 is shown as a dot and dash line. The product path is not shown in FIG. 13 structurally but is between the tucker arms 71. Arm 71 stops as it reaches the FIG. 7 or FIG. 11 position as shown by the cusp of the path in FIG. 13. It then turns slightly to form a greater angle with the end of product 53, reducing drag on wrapper 91. As shown by the dot and dash line the tip of arm 71 slows down in relation to the product and retreats backward and to the side to clear the product and to get out of the way. As shown in FIG. 13 there are only two such arms 71 per side operated to fold wrappers on successive products. Other numbers of arms are possible if properly synchronized to make the second fold.

The cam track 59 or 76 is shaped to achieve the described path.

A generally conventional folding mechanism 141 completes the folding of the sides of wrapper 91 to form the ends of the package for product 53. During this period a sealing mechanism 142 comprising a spider carrying heated wheels 143 (FIG. 8 and 26) enters each of the spaces between propelling members 125 to form a first seal at the rear edge of the package. As may be seen in FIG. 11 it is particularly important to make the seal at this point where product 53 consist of a multiplicity of articles 53A, 53*b*, 53*c*, 53*d*, because it leaves the broad sides of wrapper 91 clear and unobstructed by the damage caused by sealing the edges, for decoration or advertising while keeping the wrapper tight.

Figure 9:
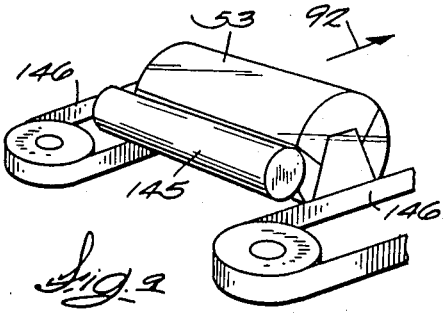

As shown in FIGS. 26 and 9, as the arrangement of the sprockets on which propelling members 125 are carried withdraws the propelling members belts 146 hold the end folds and convey products 53. A second sealing means 144 has full width end sealing bars 145 to form a full back seal. Because the sealers rotate while the motion of product 53 is linear, sealers 143 and 144 catch up to product 53 only during fastest horizontal motion, seal, then lose relative speed. At the same time belts 146 assist in maintaining the end folds until the wrapped product 53 is inserted between end sealing and conveying belts 147 which are heated at the point of initial contact to form the end seals. If necessary they may be cooled further along the product path 92 to produce a completely wrapped product 53 containing one or more articles 53*a*, 53*b*, 53*c*, 53*d*, etc.

A prototype machine which has been built and tested demonstrates the validity of the concepts expressed and proves for the first time that I am aware that product packaging speeds very much higher than those previously obtainable may be obtainable in my machine. Some of the inventions and inventive concepts here described were first arrived at during the building and testing of this machine. The machine as described is a complete and operative embodiment and is the best embodiment known. The end folding plates 141 which form the flaps of the end fold have not been fully described because they are previously known. The same is true of the various drives which drive the various parts in timed relationship to one another. For instance extensive use is made of timing belts which are lighter and cheaper than gears but which are capable of moving the parts in the required relationship.

In many cases only one side of my machine has been described because the parts are duplicated on the other side.

I claim:

1. For wrapping products at high speed, a plurality of conveyor means to move products continuously along a substantially linear and horizontal product path, means to continuously feed individual wrapping sheets in a horizontal wrapper path with forward, rear and side edges to the top of the substantially linear product path in timed relationship to the product such that each sheet travels at the same speed as the product and overlies the product along its whole length with a front edge and a substantial portion of the sheet ahead of the product as the wrapper moves along its horizontal path and the rear edge of the wrapper being behind the product in the wrappers horizontal path, means to move the front edge of the sheet across the product path ahead of the product while the remaining portion of the wrapper remains in its horizontal path as the product continues to travel whereby the sheet is drawn across the front and bottom of the product by product travel creating a bottom trailing edge of the sheet, separate means for moving the top trailing edge of the sheet and the bottom trailing edge of the sheet against the rear edge of the product in overlapping relationship, sealing means to maintain said overlapping relationship, folding means to fold the sides of the sheet against the product and sealing means to seal said folds.

2. The device of claim 1, in which said sheet is initially supported above the product path by being fed between opposed pairs of belts traveling beside the product path on each side at the same linear speed as the product, the lower belt of each such pair extending over a direction changing pulley substantially at the point at which the front edge of the wrapper is moved across the product path.

3. The device of claim 1 in which the means to move the front edge of the sheet across the product path in front of the product comprises a pair of vacuum wheels positioned on opposite sides of the product path to engage respective sides of the front edge of the sheet as they travel substantially tangent to the vacuum wheel, the vacuum wheels being rotated at a speed sufficient so that the edge may be brought across the path of the product a sufficient distance to cover the front, bottom and part of the back of the product without diminishing the speed of the product.

4. The device of claim 3 in which the vacuum wheels each rotate on an axis which is generally transverse to the linear product path.

5. The device of claim 4 in which the axis of each vacuum wheel is skewed backwardly from a true lateral direction with respect to the product path so that the front of each vacuum wheel lies slightly further laterally from the product path than the top of the same vacuum wheel.

6. The device of claim 3, in which the means to move the front edge of the sheet across the product path further comprises belts and rollers below the product path to lift the leading edge of the sheet from the vacuum wheels and carry it away from the product path while maintaining the sheet smooth, said belts and rollers being adapted to grip the sheet lightly enough so that as the product passes them the sheet may be withdrawn from between the belts and rollers without damage to the sheet and without wrinkling.

7. The device of claim 3 in which the surface of the vacuum wheel is provided with grooves extending circumferentially, and belts in said grooves smaller than the size of the grooves and extending away from the product path substantially at a tangent to the surface of the vacuum wheel to carry the sheet away from the edge of the vacuum wheel as it reaches the bottom of the product path.

8. The device of claim 7 further including at least one belt having a surface moving downwardly substantially at a tangent to the front edge of the vacuum wheel, said belt having a raised portion driven in timed relationship to the sheet movement to engage the surface of the sheet and press it against a moving surface opposing said raised portion as the front edge of the sheet moves tangent to the vacuum wheel, the raised portion being of a length such that it continues to engage the sheet only as long as the front edge of the sheet is moving away from the product path, the raised portion of the belt terminating to release the sheet for reverse movement as the product passes over it.

9. The device of claim 1 in which a section of the conveyor means beyond the place at which the sheet is brought across the product path, comprises fixed surfaces above and below the product and in contact with the product, a propelling member movably supported to enter the product path in a direction to propel the product between the surfaces and to fold a trailing edge of the sheet about the trailing edge of the product, and a second propelling member movably supported to move into the product path from a direction opposite the first such member to propel the product and to fold the other trailing edge of the sheet about the trailing edge of the product to position said trailing edges to be sealed.

10. The device of claim 9 in which said surfaces are on fixed conveyor bars, said bars on the side from which the first propelling member enters having a lower coefficient of friction with the sheet than the bars engaging the sheet at the other side of the product, whereby to move the sheet into tight engagement with the product and to move any separate articles comprising the product into close contact before sealing is effected.

11. The device of claim 9 in which the path of the first propelling member and the path of the second propelling member are both inclined in a direction that withdraws the first propelling member from the product path as the second propelling member enters the product path.

12. The device of claim 9 in which each said propelling member comprises a paddle which is discontinuous laterally to permit a sealing mechanism to enter between the portions of the paddle to secure the trailing edges of the sheet to one another, and said sealing means including a sealing mechanism propelled on a path to engage the lapped edges of the sheet and secure them at points between the paddles.

13. The device of claim 1 in which pairs of laterally extending wrapper supporting fingers directed toward the end of the product being wrapped from the sides of the product path are mounted on propelling means moving in timed relationship to the movement of the product along the product path whereby to move said pairs of wrapper supporting fingers toward the product path from the side between the top and bottom of the side edges of the sheet at a time when the trailing edges of the sheet are being folded about the rear edges of the product being wrapped, said fingers being mounted and propelled to thereafter move upwardly to support the side edges of the sheet and then to withdraw laterally to remove the support for the side edges of the sheet, and an air-jet adapted to blow downwardly at a side edge of the sheet to keep it from clinging by static attraction to the conveying means and to assist in forming a first end fold in the sheet.

14. The device of claim 1 in which said sealing means includes a sealing mechanism as wide as the product which completes the rear seal by engaging the overlapping trailing edges of the sheet at the rear of the product and simultaneously being part of the means to propel it along the product path.

15. In a product wrapping machine, means for continuously moving a product to be wrapped in a substantially linear and horizontal path at a substantially constant speed along said path, means for continuously supplying individual wrappers in a horizontal wrapper path in timed relationship to each product moving along said product path, each said wrapper comprising a sheet having a forward edge, side edges, and a rear edge, said wrappers being supplied in a path along the side of said product path with the forward edge of the individual wrapper substantially ahead of said product and the rear edge of the wrapper being a smaller distance behind said product so that the wrapper lies along a path length greater than the whole length of the product, means to grip said wrapper by its side edges and move it at a speed synchronous with the speed of the product, and means to hold and transfer the forward edge of the wrapper across the product path while the remaining portion of the wrapper remains in its horizontal path without distorting the wrapper and means to frictionally grip said wrapper and urge it transversely to the product path in a very light frictional grip by a member that operates in timed relationship to the linear speed of the product propelling mechanism to extend a substantial distance past the product path on the other side so that the continuous movement of the product brings the wrapper across the front of the product and the forward edge of the wrapper becomes a second trailing edge behind the product to be secured about the rear of the product to completely envelop the product.

16. The device of claim 15 in which the means to transfer the forward edge of the wrapper across the path of the product includes a pair of vacuum wheels respectively located on each side of the product path with the outer surfaces of the vacuum wheels substantially tangent to the path of the forward edge of the wrapper.

17. The device of claim 16 in which the diameter of the vacuum wheels is substantially larger than the height of the product moving on the product path.

18. The device of claim 15 further comprising pairs of plastic belts extending substantially at right angles to the product path to grip the forward edge of the wrapper as it is transferred across the product path, said pairs of belts moving said forward edge at right angles to the product path until movement of the wrapper in said direction and movement of the product along the product path tighten the wrapper along the front of the product.

19. The device of claim 15 including a belt having a portion of its path extending substantially at right angles to the product path, said belt being provided with a limited length of a wrapper engaging portion which is thicker than the remainder of the belt, the movement of the belt being so timed with respect to the movement of the forward edge of the product wrapper that the thicker portion of the belt and the forward edge of the wrapper arrive at the portion of the belt extending substantially at right angles to the product path at the same time and means opposed to the thickened portion to interact with said thickened portion to grip the forward edge of the wrapper, the length of the thicker portion of the belt being selected to release the product wrapper easily when the product passes the portion of the belt path extending substantially at right angles to the product path.

20. The device of claim 19 in which a belt is the means that interacts with the belt having the thickened portion, and a roller in close proximity to the belt with the built up portion, but positioned to raise only the built up portion of the belt to interact.

21. Means for tightening a wrapper about a product to be wrapped comprising at least first and second surfaces spaced to permit a product to be propelled horizontally between said surfaces, means to supply a product with a wrapper about its top, front and bottom sides to the space between said surfaces at a constant speed, said wrapper having a trailing free edge at the top and another trailing free edge at the bottom, with said wrapper at said product top and bottom in sliding frictional engagement with said surfaces, first propelling means for pushing one said free edge of the wrapper that is in frictional contact with said first surface against the rear of the product and for propelling the product at constant speed between said surfaces, said first surface in frictional engagement with said wrapping having lower friction with respect to said wrapper than said second surface whereby said propelling means retains the margin of said wrapper at the rear of the product while the higher friction of the second surface pulls the wrapper tightly about the product and closes any spaces between articles composing the product as the product is propelled between said surfaces.

22. The device of claim 21 in which a second propelling means pushes the margin of the wrapper farthest from the edge retained by the first propelling means against the rear edge of the product, and means to secure the wrapper in that position.

23. The device of claim 22 further comprising an air-jet positioned to blow on the side of the wrapper to form the first portion of an end fold.

24. The device of claim 23 further comprising wrapper side supporting fingers having support means carrying the fingers alongside the product path to support the side margins of the wrapper, the support means carrying the fingers away from the product path to withdraw said fingers from between the side margins of the wrapper before the said side margins of the wrapper are folded in to become end folds of the product package.

* * * * *

UNITED STATES PATENT AND TRADEMARK OFFICE

CERTIFICATE OF CORRECTION

PATENT NO. : 4,624,096

DATED : November 25, 1986

INVENTOR(S) : John E. Nordstrom

It is certified that error appears in the above-identified patent and that said Letters Patent is hereby corrected as shown below:

On the title page assignee should read

-- (73) Assignee: Omega Mfg. Corporation --.

Signed and Sealed this

Fourteenth Day of April, 1987

*Attest:*

DONALD J. QUIGG

*Attesting Officer*

*Commissioner of Patents and Trademarks*